US006847292B2

(12) United States Patent
Nlabu

(10) Patent No.: US 6,847,292 B2
(45) Date of Patent: Jan. 25, 2005

(54) METHOD AND DEVICE FOR REMOTE UNLOCKING OF AN ACCESS DOOR OF A BUILDING WITH AN ELEVATOR

(75) Inventor: Frédéric Nlabu, Küssnacht am Rigi (CH)

(73) Assignee: Inventio AG, Hergiswil (CH)

( * ) Notice: Subject to any disclaimer, the term of this patent is extended or adjusted under 35 U.S.C. 154(b) by 64 days.

(21) Appl. No.: 10/316,574

(22) Filed: Dec. 11, 2002

(65) Prior Publication Data

US 2003/0117292 A1 Jun. 26, 2003

(30) Foreign Application Priority Data

Dec. 20, 2001 (EP) ..... 01130415

(51) Int. Cl.[7] ..... G08B 1/08

(52) U.S. Cl. ..... 340/539.1; 340/286.06; 187/390; 187/391

(58) Field of Search ..... 340/539.1, 539.16, 340/539.17; 70/91, 92, 465; 187/390, 391, 393, 395

(56) References Cited

U.S. PATENT DOCUMENTS 5,345,046 A * 9/1994 Rynaski et al. ..... 187/390
5,714,726 A * 2/1998 Ketoviita ..... 187/391
5,736,694 A * 4/1998 Ketoviita ..... 187/391
6,196,355 B1 * 3/2001 Fargo et al. ..... 187/393
6,269,910 B1 * 8/2001 Fargo et al. ..... 187/287
6,364,066 B1 * 4/2002 Bolch et al. ..... 187/391

FOREIGN PATENT DOCUMENTS

| | | |
|---|---|---|
| JP | 03128879 | 5/1991 |
| JP | 04173677 | 6/1992 |
| JP | 10218518 | 8/1998 |

* cited by examiner

*Primary Examiner*—Toan N. Pham
(74) *Attorney, Agent, or Firm*—MacMillan, Sobanski & Todd, LLC

(57) ABSTRACT

An apparatus and method for the emergency release of passengers who are trapped in an elevator car due to an operational disturbance includes a remote alarm device in the elevator car for summoning help from outside the building and equipment for the remote actuation from the elevator car of an electrical closing or locking system of a building outer door. Expert service personnel summoned from outside the building thus gain access to the elevator even when the building door is locked in order to release the trapped passengers. The actuation can be by a specific button installed in the car control panel or through input of a code or by a button combination of the control panel elements. According to a preferred embodiment, the remote unlocking is possible only temporarily, so as to prevent misuse of the emergency situation.

16 Claims, 2 Drawing Sheets

METHOD AND DEVICE FOR REMOTE UNLOCKING OF AN ACCESS DOOR OF A BUILDING WITH AN ELEVATOR

BACKGROUND OF THE INVENTION

The present invention relates generally to a method for remote unlocking of an access door of a building with an elevator and a device, which is suitable for that purpose, and has the object of making access to the building and to the elevator installed therein possible for persons from outside the building when in the case of power failure or other operational disturbances of the elevator, the elevator car remains stuck between two floor stopping positions and the passengers can not leave the elevator car without outside help.

It is already known for such cases of emergency to keep elevator-relevant systems in operation for a limited time by way of emergency power supply equipment in order to be able to actuate in the elevator car, additionally to an emergency lighting, a remote alarm device with intercom equipment for summoning expert help.

SUMMARY OF THE INVENTION

The present invention is in principle usable in any elevators installed in buildings in which access to the elevator from outside the building is provided by way of a door and the door is equipped with a generally known electrical closing or locking system which is electrically remotely actuated by means of the door opening button of a remote actuating device. However, special uses are offered for elevators in non-public buildings, such as single family houses, i.e. so-termed "home elevators". If at the time of operational disturbance no other persons are present in the building apart from the passengers trapped in the elevator car, then expert service personnel summoned from outside the building for the emergency release cannot get to the elevator if the building door is locked. The service personnel coming for help or summoned by way of the remote alarm device consequently have to gain access to the building and the stopped elevator forcibly or, however, by bringing in a key service. Both are connected with additional costs for the elevator owner and require additional time until the passenger is freed from his or her uncomfortable situation in the stuck elevator.

The present invention is based on the recognition that the afore-mentioned deficiency can be eliminated by the known equipment and mode of remote actuation in the case of building doors with electrical closing and locking system and therefore proposes an unlocking or opening of an access door of the building from the elevator car.

Thus, a passenger trapped in the elevator car can make available access to the car for persons summoned from outside the building and the emergency release or evacuation of the passenger in situ at the elevator can be undertaken without delay in time or addition cost.

A controlled access as protection against misuse of the emergency situation is achieved in that the device for remote unlocking of the access door from the car is enabled only temporarily. An access possibility to the building can thus be restricted to a time period.

In that case the possibility of getting into the building can additionally be restricted to specific persons in that the remote unlocking is coordinated by way of the intercom connection. The timing and the identification of the service personnel summoned for help are thus guaranteed by way of verbal control.

In a preferred embodiment of the method according to the invention the device for remote unlocking of the access door is activated, i.e. connected with the emergency power supply equipment, as soon as a speech connection with a local, so-termed service control center, which is separate from the building with the elevator, is established by way of the remote alarm device.

Another advantageous embodiment proposes that actuating equipment for unlocking the electrical closing and unlocking system is activated by the service control center.

Further preferred embodiments of the remote unlocking according to the present invention propose an actuation of a button installed in the elevator car or by the input of a specific code or by the input of a button combination of the car elements.

The end of the activation of the device for remote unlocking of the access door is in advantageous manner coupled with the occurrence of an event. Preferably, the actuating device is again deactivated, i.e. separated from the emergency power supply and/or reset when a predeterminable time period has expired, or an acknowledgement of the electrical closing and locking system is made to the elevator control, or a change in the position of the car is registered by the elevator control.

An advantageous refinement of the device in accordance with the present invention for remote actuation of an access door of a building with a elevator consists in that this is completely integrated in the car control panel. Actuating device and elevator control can thus be installed in the car completely premounted in the car control panel. This on the one hand simplifies power supply of the device according to the present invention by the emergency power supply equipment and on the other hand expresses itself positively in overall costs by low additional outlay.

A further advantageous refinement proposes a decentralized arrangement of the device for remote actuation. An actuating device is integrated in the car control panel, whereas the elevator control is arranged at any location outside the car subassembly, for example in the shaft or on the floors. Actuating device and elevator control communicate with one another by way of a elevator data bus which is in any case already present for data transmission between the car control panel and the elevator control. The elevator control issues the unlocking signal to the locking and closing mechanism and in a given case receives therefrom an acknowledgement.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
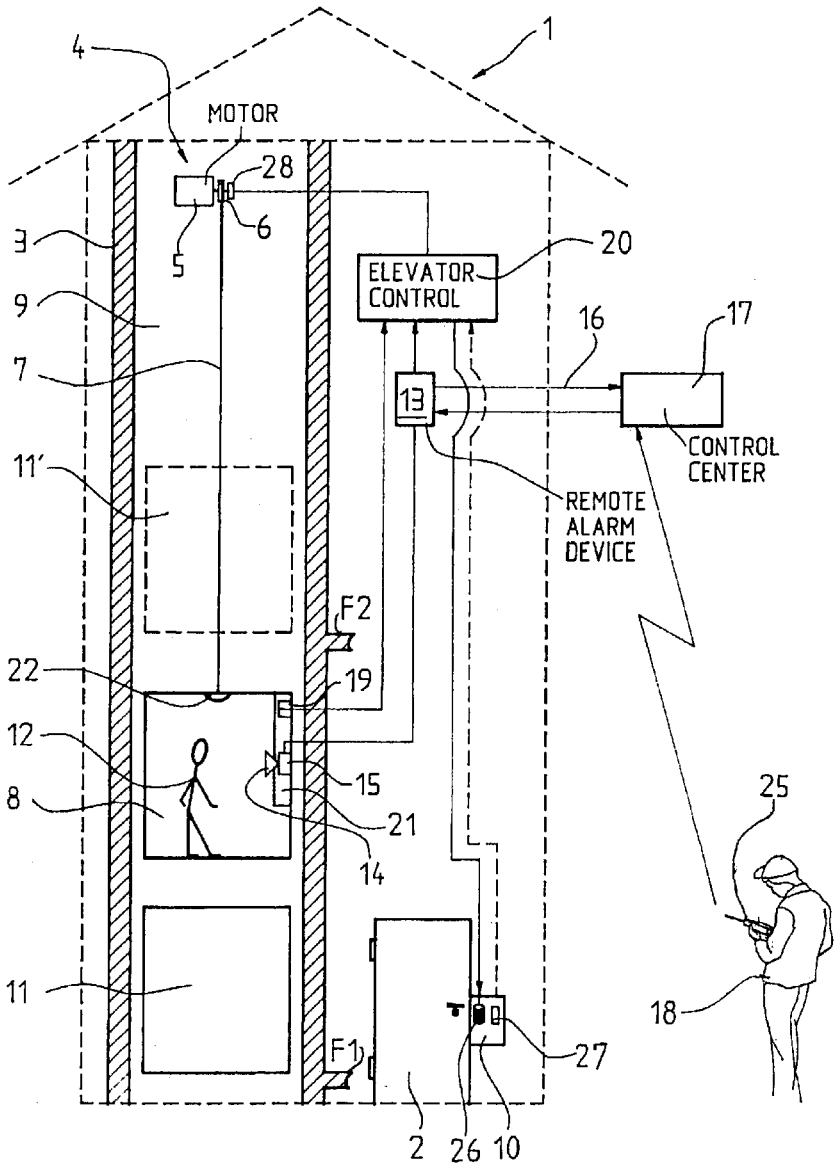
FIG. 1 is a schematic view of an embodiment of the present invention installed in a building.

FIG. 1 shows a building 1, which is illustrated by dashed lines, with a door 2 by way of which access is possible from outside the building 1 to an elevator 3 installed therein. The elevator 3 comprises a cable drive 4 with a motor 5, which acts on a pulley 6 driving a support cable 7, which supports at one end an elevator car 8 and at the other end a counterweight (not illustrated) and raises and lowers them in an elevator shaft 9. The door 2 of the building 1 is equipped with a generally known electrical closing or locking system 10.

FIG. 1 shows the elevator 3 in the case of an operational disturbance, here a power failure, as a consequence of which the elevator car 8 is stuck in the elevator shaft 9 in a position between adjacent door zones 11, 11' of two floors F1, F2 respectively. Or, in a position where the elevator car 8 is at a floor, for example at floor F1, with doors (car door and/or elevator shaft door) closed. A passenger 12 is located in the elevator car 8 and can leave only with outside help. For such an emergency case the elevator car 8 is equipped with emergency devices, such as emergency lighting 22 and a remote alarm device 13 with intercom equipment 14, which together with the electrical closing and locking system 10 of the door 2 are supplied with electrical power by emergency power supply equipment (not illustrated). An emergency call or an emergency signal for summoning expert service personnel for emergency release can be placed at a service control center 17 of the elevator operator by the remote alarm device 13 with the intercom equipment 14 in known manner by actuation of an alarm button 15, for example by way of a communication link 16 in the form of wire or via radio, for example over a telephone network. The intercom equipment 14 can also be provided for the transmission of video signals on the communication link 16 so that in the case of actuation in an emergency a reciprocal video and audio communication between the passenger 12 in the elevator car 8 and the service control center 17 is possible.

Figure 2:
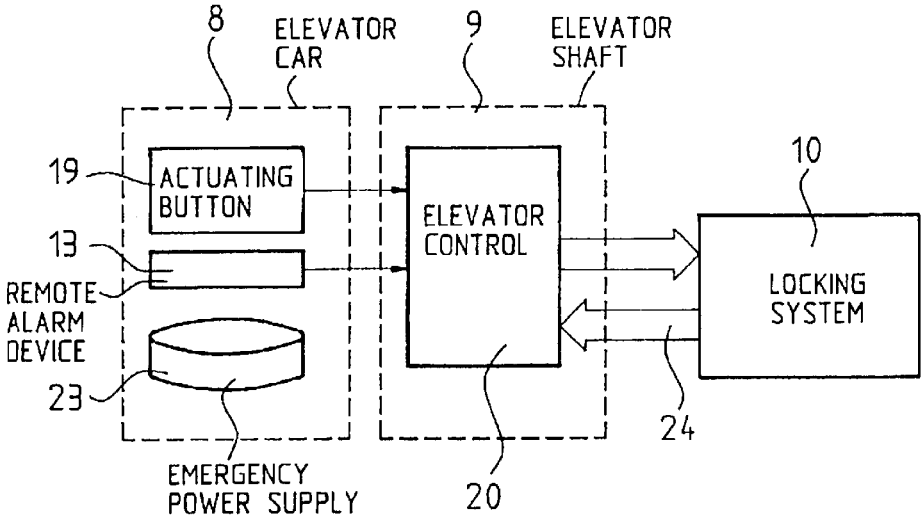
FIG. 2 is a block diagram of a first embodiment of the remote actuating device of the present invention.

FIG. 2 shows schematically a so-termed decentralized build-up of an embodiment of the device according to the present invention for remote actuation of the locking or closing mechanism 10 of the door 2. The actuating device, i.e.—in correspondence with the embodiment illustrated in FIG. 1—such as an actuating button 19 and the remote alarm device 13 with the intercom equipment 14, are arranged in the elevator car 8 together with an emergency power supply system 23 supplying them with electrical energy. An elevator control 20 is locally separated therefrom, for example mounted in the elevator shaft 9 in the vicinity of the cable drive 4. The actuating device 19 and the remote alarm device 13 communicate with one another by way of, for example, the car bus. The elevator control 20 is operatively connected with the electrical closing and locking system 10 of the door 2; on the one hand it actuates the closing and locking system 10 and on the other hand it receives an acknowledgement signal 24 when the closing and locking system 10 is unlocked.

Figure 3:
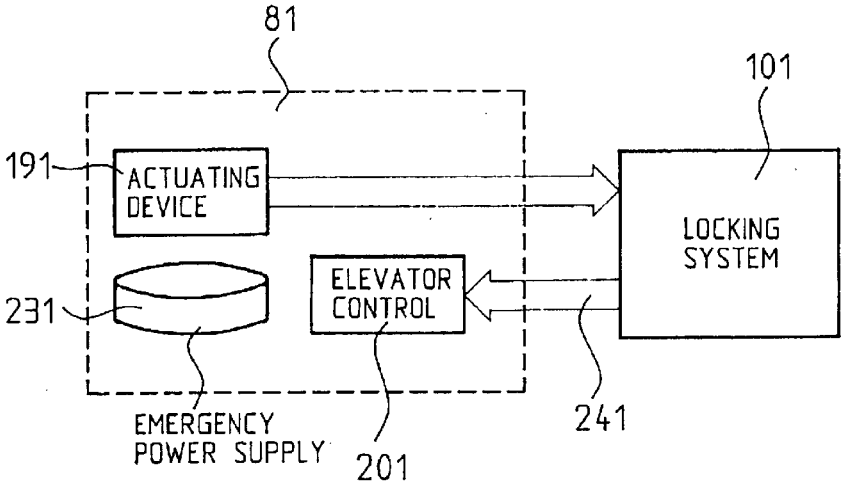
FIG. 3 is a block diagram of a second embodiment of the remote actuating device of the present invention.

A second embodiment with a so-termed centralized construction is illustrated in FIG. 3. In that case an actuating device 191, an emergency power supply system 231 and an elevator control 201 are accommodated in an elevator car 81. The actuating device 191 is, for control, disposed in direct connection with a closing and locking system 101, whilst the elevator control 201 receives an acknowledgement signal 241 from the closing and locking system 101.

Independently of the selected construction of the remote unlocking device, the actuation thereof takes place by way of an actuating device installed in the car 8. The actuating device can, as shown in FIG. 1, be represented as the separate door opening button 19 or, however, by transmitter elements already present in a car control panel 21, wherein in the case of the latter embodiment the remote actuation of the closing and unlocking system 10 of the door 2 can be carried out by the input of a specific code or a specific button combination of the transmitter elements of the car control panel 21.

The method and the device, to the extent illustrated, for remote unlocking of the door 2 of the building 1 with the elevator car 3 operates as follows:

If during a transport travel, for example, the energy supply of the car 3 fails, the drive 4 stops and the elevator car 8 (or 81) stands still in its instantaneous position, which is illustrated in FIG. 1. The emergency power supply equipment 23 (or 231) switches on automatically immediately with the power failure and keeps emergency devices in operational readiness.

The passenger 12 trapped in the elevator car 8 (or 81) actuates the alarm button 15 of the remote alarm device 13, whereupon the latter on the one hand issues a signal to the elevator control 20 (or 201) and switches this over to the alarm mode and on the other hand forms a telephone connection 16 between the elevator car 8 (or 81) and the service control center 17, by way of which the passenger 12 can draw attention by means of the intercom equipment 14 to his or her emergency situation that has arisen.

The alarm call is received in the service control center 17, whereupon an expert service operative 18 for the emergency release is sent to the stuck elevator 3 and it is communicated to the trapped passenger 12 that help for him or her is underway. Arriving on site at the building 1 concerned, the elevator service operative 18 stands in front of the closed door 2 and initially has no access to the elevator 3. Accordingly the service operative 18 reports to the service control center 17 by way of, for example, a mobile radio telephone 25. After this verbal access authorization, the service control center 17 in turn now requires the trapped passenger 12 by way of the intercom equipment 14 to press the actuating button 19 (or 191) connected to the remote actuating equipment 10 (or 101) and 20 (or 201).

On actuation of the actuating button 19 (or 191), a switching signal is issued to the remote actuating device, which here is integrated in the elevator control 20 (or 201) and which thereupon, for example, supplies current to a magnet coil 26 of the electrical closing and locking system 10 (or 101) and thus unlocks the door 2.

The acknowledgement signal 24 (or 241), which here is produced by means of a control relay 27 of the closing and locking system 10 (or 101), is conducted to the elevator control 20 (or 201) and indicates to this that the locking and closing mechanism 10 (or 101) is unlocked or that the service operative 18 now has access to the building 2 and the elevator 3 installed therein and can undertake the emergency release. The acknowledgement signal resets the elevator control 20 (or 201) from the alarm mode, which was set in the case of triggering the alarm, back again to the normal control mode.

The acknowledgement signal triggering the switching over of the elevator control 20 (or 201) to the normal operating mode can also be derived from equipment for measuring the position of the elevator car 8 (or 81), for example an incremental transmitter 28 of the drive 5, for the elevator control 20 (or 201). In such an embodiment there is switching back from the alarm mode to the normal operating mode as soon as a change in the position of the elevator car 8 (or 81), for example in the framework of the emergency release, is registered.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of remote unlocking of an access door of a building having an elevator, the building access door being equipped with an electrical closing or locking system, comprising the steps of:

a. providing a remote alarm device in an elevator car installed in a building;

b. providing a remote actuating device in the elevator car;

c. operating the remote alarm device to switch a control for the elevator car from a normal control mode to an alarm mode and enabling the remote actuating device;

d. operating the remote actuating device to unlock an electrical closing or locking system associated a door of the building; and e. resetting the control to the normal control mode.

2. The method according to claim 1 including enabling the remote actuating device to unlock the electrical closing or locking system only when the control is in the alarm mode.

3. The method according to claim 1 wherein said step c. includes operating the remote alarm device to summon help from outside the building.

4. The method according to claim 1 wherein said step d. is performed after establishing a speech connection between the elevator car and a control center by way of the remote alarm device.

5. A method of remote unlocking of an access door of a building having an elevator, the building access door being equipped with an electrical closing or locking system, comprising the steps of:

a. providing a remote actuating device in an elevator car installed in a building;

b. establishing a speech connection between the elevator car and a control center external to the building through the remote alarm device; and c. subsequent to performing said step b., operating the remote actuating device from inside the elevator to unlock an electrical closing or locking system associated an outside door of the building.

6. The method according to claim 5 including a step of enabling the remote actuating device to unlock the electrical closing or locking system only when a predetermined operating condition of the elevator car is present.

7. The method according to claim 6 wherein the predetermined operating condition of the elevator car is an alarm mode of a control associated with the elevator car.

8. The method according to claim 5 including providing a remote alarm device in the elevator car and operating the remote alarm device to summon help from outside the building.

9. The method according to claim 8 wherein said step b. is performed by establishing a speech connection between the elevator car and a control center external to the building through the remote alarm device.

10. The method according to claim 5 including enabling the electrical closing or locking system to be immediately responsive to the operation of the remote actuating device for unlocking the electrical closing and unlocking system.

11. The method according to claim 5 including providing one of an actuating button and car control elements in the elevator car for operating the remote actuating device.

12. A device for remote unlocking of an access door of a building having an elevator, wherein the access door is equipped with a locking system, comprising:

a control for operating an elevator car in a building in a normal control mode of said control;

an actuating device mounted in the elevator car and connected to said control;

means for establishing a speech connection between the elevator car and a person external to the building; and a building external door locking system connected to said control wherein said actuating device operates said locking system through said control to unlock an associated building external door only if the speech connection has been established.

13. The device according to claim 12 wherein said actuating device is integrated in a car control panel of the elevator car.

14. The device according to claim 12 wherein said actuating device is connected to said control through a car control bus.

15. The device according to claim 12 wherein said locking system resets said control to the normal control mode upon unlocking the door.

16. The device according to claim 12 including a remote alarm device mounted in the elevator car for summoning help from outside the building.

* * * * *